US005163173A

United States Patent [19]

Casagrande

[11] Patent Number: 5,163,173

[45] Date of Patent: Nov. 10, 1992

[54] VARIABLE IMPEDANCE TRANSFORMER WITH EQUALIZING WINDING

[75] Inventor: Serge Casagrande, Windsor, Canada

[73] Assignee: Top Gulf Coast Corporation, Tampa, Fla.

[21] Appl. No.: 677,768

[22] Filed: Mar. 29, 1991

[51] Int. Cl.[5] ..... G05F 7/00

[52] U.S. Cl. ..... 323/335; 323/338; 336/73; 336/155

[58] Field of Search ..... 323/251, 253, 249, 329, 323/332, 335, 338; 336/155, 73

[56] References Cited

U.S. PATENT DOCUMENTS 1,910,381 5/1933 Dowling ..... 336/73

4,019,123 4/1977 Maskery ..... 336/73

*Primary Examiner*—William H. Beha, Jr.

*Attorney, Agent, or Firm*—Früouf, Rust & Pyle

[57] ABSTRACT

An apparatus and method is disclosed for an improved variable impedance transformer for controlling the power from an alternating input power source to a load in accordance with a direct current control signal. The invention comprises a DC control winding simultaneously wound about a plurality of saturable reactor cores and a plurality of AC power input windings simultaneously wound about a power core and each of the saturable reactor cores. A power output winding is wound about the power core for delivering power to the load. A low impedance equalizing winding is wound about the saturable reactor cores for shunting any resultant alternating voltage as a result of physical variations between the saturable reactor cores.

22 Claims, 9 Drawing Sheets

VARIABLE IMPEDANCE TRANSFORMER WITH EQUALIZING WINDING

BACKGROUND OF THE INVENTION

1. Field Of The Invention

This invention relates to a variable impedance transformer, and more specifically to a method and means for minimizing an alternating voltage induced in control windings.

2. Background Of The Invention

Saturable reactors, and more specifically variable impedance transformers provide an extremely rugged, substantially maintenance free means to control large amounts of AC power delivered to large lighting loads, heavy duty electric motors and the like. The high secondary AC power levels are controlled by relatively low DC control power levels wherein the DC control power establishes levels of magnetic flux saturation in appropriate cores proportional to the required AC power output level as is well known to those skilled in the art. Offsetting these desirable characteristics are some disadvantages in using these systems. The variable impedance transformer is bulky, heavy, and has a relatively slow response time when compared to other power control systems. A final problem encountered with saturable reactors, and more particularly a variable impedance transformer is the alternating voltage induced in the DC control windings by the magnetic flux within the AC primary windings/ DC control winding common core(s).

The induced alternating voltage in the DC control windings places restrictions on the design and operation of the DC control power source. Designers have attempted to solve this deficiency by installing bulky heat sinks, large semiconductors and resistors in parallel with the control windings. Various resistance-capacitance solutions have been described and some designers have attempted to solve this problem by placing a plurality of opposed DC control windings on the control core such that the induced AC voltages cancel each other. In another system, a plurality of AC primary winding/DC control winding common cores are oriented in a manner such that the magnetic flux of a first core flows in opposition to the magnetic flux of a second core proximate the DC control winding thereby having a substantially canceling effect of the magnetic fluxes thereby minimizing the induced AC voltage in the DC control winding.

U.S. Pat. No. 2,498,475 to John Q. Adams teaches a saturable magnetic core with a core construction possessing a characteristic of constant permeability over a specified range of magnetomotive force. Utilizing a two section core assembly with a DC polarizing coil around a first section of the core assembly such that the algebraic sum of the magnetization curves of the polarized and unpolarized core sections is a straight line.

U.S. Pat. No. 2,586,657 to William J. Holt, Jr. teaches a variable voltage transformer for controlling a load voltage by means of an adjustable DC voltage applied to a DC control winding. The device utilizes a plurality of cores with two primary windings, each of the primary windings is simultaneously wound about a secondary core and a saturable core. A secondary winding is wound about each of the secondary cores and the secondary windings are connected in parallel to the load. The DC control winding is wound about both of the saturable cores for controlling the flux level in each of the saturable cores. A flux is induced in each of the saturable cores which are positioned proximate each other by means of an AC voltage applied to the primary windings. The fluxes are opposite and equal to each other, thereby canceling each other and thereby producing substantially zero or little induced AC voltage in the control winding.

U.S. Pat. No. 2,870,397 to Fred W. Kelley, Jr. teaches an improved saturable core apparatus utilizing three cores with two of the cores being saturable by means of a DC control source and the third core acting as a flux conductor for a primary input and secondary output transformer. Two primary windings are wound about the third core in parallel with opposing diodes or rectifiers placed in the path of the primary windings so that the windings only conduct during alternate half cycles of an AC wave.

U.S. Pat. No. 3,087,108 to Domonic S. Toffolo teaches the efficient transfer of power from a source to a load which can operate at 500 degrees Fahrenheit. This device uses a primary, secondary core and a control core, with the primary winding being simultaneously wound about both the primary and secondary cores, the secondary output winding being wound about the secondary core, and the control core about which the control winding is wound. The control winding and control core are at right angles to the primary core with an air gap existing between the control winding core and the solid primary core. In operation the effect of the magnetic flux in the right angle control core produces a saturation in the primary core whereby the AC produced flux flows proportionally through the secondary core, subsequently inducing a voltage in the secondary output winding.

U.S. Pat. No. 3,123,764 to Henry W. Patton teaches the construction of a magnetic amplifier and control device. The signal is impressed on three windings wound about a plurality of cores with the output being taken from two of the cores with a third core being a nonsaturating member for generating a counter electromotive force in the signal input winding to modify the effects of distributive capacitance currents in the amplifier circuit.

U.S. Pat. No. 3,221,280 to James S. Malsbary et al teaches a saturable reactor which does not require divided reactance or control windings to prevent flow of induced AC of the supply frequency in the control winding and is also used in a polyphase system with a minimum number of separate windings. The patent further teaches a three phase system utilizing the loads being in series with the load windings on the cores and each phase of the power supply around which a single control winding surrounds all three phase cores and a fourth core called an auxiliary magnetic core. In a balanced three phase circuit the algebraic sum of the magnetic flux is equal to zero. If the loads become unbalanced, the flux becomes unbalanced which then produces a current in the control windings. The unbalanced flux produces a current in the auxiliary core which opposes and substantially cancels the current in the control core.

U.S. Pat. No. 3,505,588 to Elwood M. Brock teaches a load impedance responsive feedback system for a variable reactance transformer. The variable transformer has three cores, and primary, secondary, control, and feedback windings. A secondary winding and a feedback supply winding are wound on the secondary winding, while the two auxiliary cores carry DC external control and DC feedback control windings. The primary winding is wound around all three cores.

U.S. Pat. No. 3,343,074 to Elwood M. Brock teaches a variable reactance transformer having two saturable cores. The variable reactance transformer has two saturable cores with control windings, a power core with secondary output winding and a primary winding surrounding all three cores and is wound on top the DC and secondary windings. This device uses control windings wound in series opposition thereby creating a bucking current for any induced voltage in the control windings by the primary current flux. Any residual voltage component is dropped across a shunting resistor in parallel with the two control windings.

U.S. Pat. No. 4,129,820 to Elwood M. Brock teaches a variable reactance transformer having a main core and a pair of auxiliary cores whereby the auxiliary cores carry the DC control windings which are divided in that a first winding is wound about the core and a second coil is wound about the first coil and wherein all the control coils are wound in series and in a configuration such that the induced voltages are substantially zero.

U.S. Pat. No. 4,574,231 to Donald W. Owen teaches a magnetic amplifier apparatus for balancing or limiting voltages or currents. The apparatus comprises of a first level of magnetic amplifiers which are responsive to a DC control signal. The output of the first level magnetic amplifier provides an input signal for a second level of magnetic amplifiers having gate windings to which the alternating current to be controlled is connected.

Although the above stated devices provide control of AC power by means of a DC control signal, all of the devices suffer from a deficiency in that the devices allow an AC voltage to be induced in the DC control windings.

The adverse effects of the induced AC voltage in DC control windings are well known to those skilled in the art. The AC voltages require added considerations to be made in the design and construction of the DC windings and power supplies. Should the AC voltages exist at substantial levels, the counter EMF developed in the DC windings by the AC voltages could not only prevent saturation of the magnetic core of the saturable reactor but severely damage components in the D.C. control circuit. Winding wire sizes and the number of windings become design constraints, and power supplies require large semiconductors or heat sinks to absorb the effects of the AC voltage, adding to unit weight and cost. Elimination of the induced AC voltage allows greater flexibility in both the saturable reactor and associated power supply designs. When no longer constrained by the induced AC voltage the designer may use as many turns as practical in control windings and size the wire to obtain the resistance required for the correct control cur rent. Although attempts to eliminate the undesirable effects of the induced AC voltage in the DC control windings has met with limited success none of the above stated devices has substantially eliminated the unwanted AC voltage. Non-significant differences or variations in cores and windings are sufficient to produce low levels of induced AC voltages in DC windings.

Therefore, it is an object of the present invention to provide an improved variable impedance transformer for controlling the power from an alternating input power source to a load in accordance with a direct current control signal.

Another object of this invention is to provide an improved variable impedance transformer wherein the first and second saturable reactor cores and the first and second power input windings are established and positioned to substantially cancel the magnetic flux proximate the control winding.

Another object of this invention is to provide an improved variable impedance transformer wherein an equalizing winding is simultaneously wound about the first and second saturable reactor cores for shunting any resultant alternating voltage induced by any residual magnetic flux as a result of nonsubstantial physical variations between the first and second saturable reactor cores.

The foregoing has outlined some of the more pertinent objects of the present invention. These objects should be construed as being merely illustrative of some of the more prominent features and applications of the invention. Many other beneficial results can be obtained by applying the disclosed invention in a different manner or modifying the invention with in the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to a variable impedance transformer, and more specifically to an improved method and apparatus for minimizing an alternating voltage induced in control windings. The variable impedance transformer for controlling power from an alternating input power source to a load in accordance with a direct current control signal is provided with a first and a second saturable reactor core and power core means. First and second power input windings are simultaneously wound about the power core means and the first and second saturable reactor cores, respectively. A means connecting the first and second power input windings in parallel across the alternating input power source is provided for establishing a magnetic flux in the power core means and for establishing a magnetic flux in the first and second saturable reactor cores. A power output means winding for transferring power to the load is wound about the power core means and a control winding is wound about the first and second saturable reactor cores for controlling saturation of the magnetic flux in the first and second saturable reactor cores in accordance with the direct current control signal. The first and second saturable reactor cores and the first and second power input windings are established and positioned to substantially cancel the magnetic flux proximate the control winding. An equalizing winding is wound about the first and second saturable reactor cores for shunting any resultant alternating voltage induced by any residual magnetic flux as a result of non-substantial physical variations between the first and second saturable reactor cores.

Preferably, the equalizing winding is connected to a low impedance or is shorted for neutralizing any resultant alternating voltage induced by the first and second saturable reactor cores. In one embodiment of the invention, the control winding has a substantially greater number of turns than the equalizing winding.

The first and second saturable reactor cores and the first and second power input windings are substantially identical to one another for substantially canceling the magnetic flux proximate the control winding. Each of the first and second saturable reactor cores and the power core means provides a closed loop for the magnetic flux.

In another embodiment of the invention, the power core means comprises a first power core with a first power input winding being simultaneously wound about a first power core and a first saturable reactor core. A second power input winding is simultaneously wound about the first power core and a second saturable reactor core. The power output winding means comprising a first power output winding wound about the first power core.

In another embodiment of the invention, the power core means comprises a first and second power core with the first power input winding being simultaneously wound about the first power core and the first saturable reactor core and a second power input winding being simultaneously wound about a second power core and a second saturable reactor core. A means is provided for connecting the first and second power input windings across the alternating input power source establishing a magnetic flux in the first and the second power cores propagating in the same direction. A power output winding means is provided comprising a first power output winding wound about the first power core and a second power output winding wound about the second power core. A means connecting the first and second power output windings is provided, wherein the first and second power output windings are connected in parallel.

In another embodiment of the invention, the power core means comprises a first and second power core with the first power input winding being simultaneously wound about the first power core and the first saturable reactor core and a second power input winding being simultaneously wound about a second power core and a second saturable reactor core. A means is provided for connecting the first and second power input windings across the alternating input power source establishing a magnetic flux in the first and the second power cores propagating in the opposing direction. A power output winding means is provided comprising a first power output winding wound about the first power core and a second power output winding wound about the second power core. A means connecting the first and second power output windings is provided, wherein the first and second power output windings are connected in parallel.

The invention is also incorporated into the method of reducing a residual alternating voltage across a control winding of a variable impedance transformer having a first and a second saturable reactor core and a power core means. The method details the winding of identical first and second power input windings about the power core means and the first and second saturable reactor cores, respectively, as well as, winding a control winding about the first and second saturable reactor cores, and winding an equalizing winding about the first and second saturable reactor cores. The invention further describes connecting the equalizing winding to a low impedance for absorbing any residual alternating voltage induced between the first and second saturable reactor cores due to physical variations therebetween.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
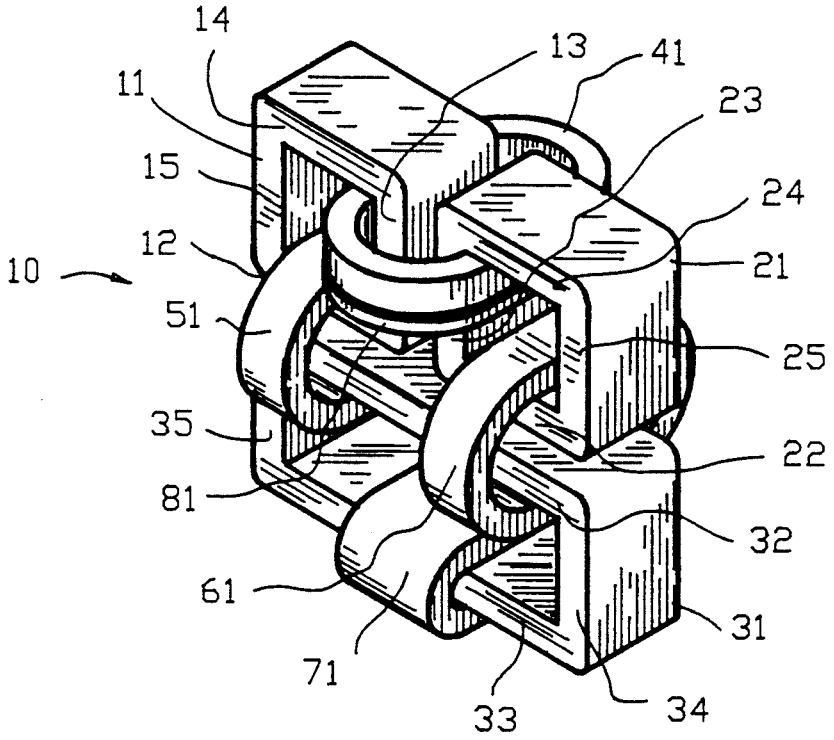
FIG. 1 is an isometric view of a first embodiment of a variable impedance transformer incorporating the present invention.
Figure 2:
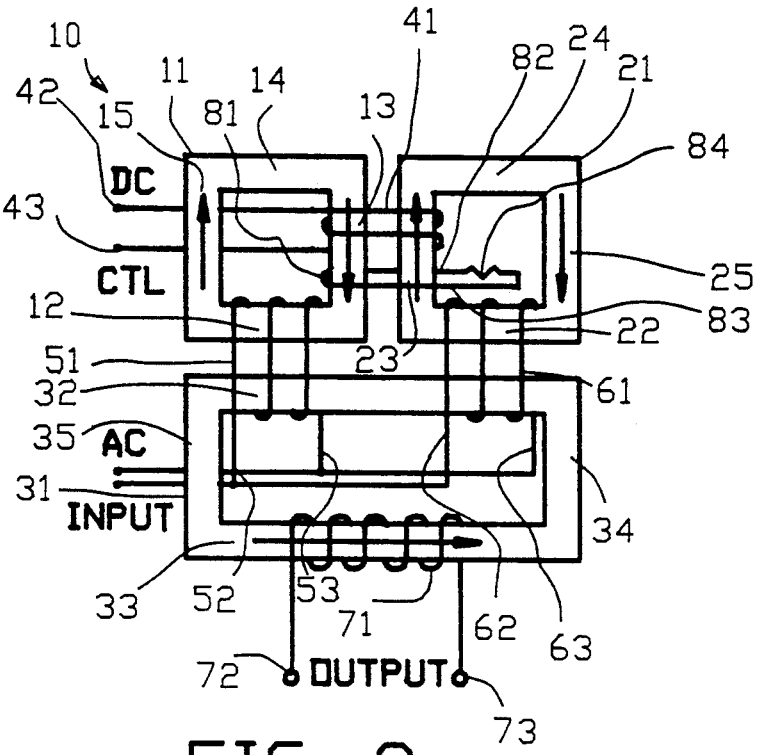
FIG. 2 is a circuit representation of the first embodiment of the variable impedance transformer illustrating the magnetic flux directions during a first half cycle of an alternating current wave.
Figure 3:
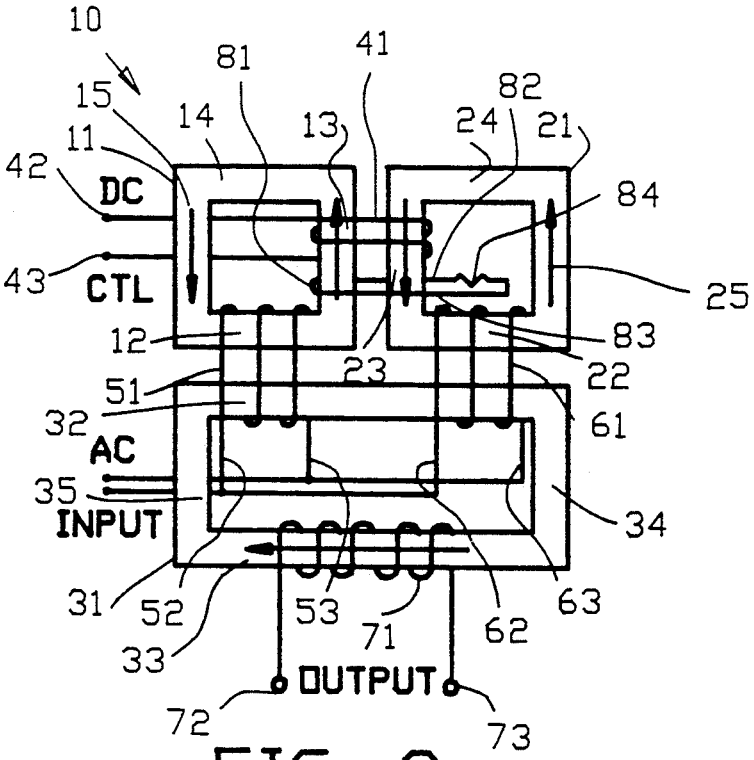
FIG. 3 is a circuit representation of the first embodiment of the variable impedance transformer illustrating the magnetic flux directions during a second half cycle of an alternating current wave.

FIG. 1 is an isometric view of a first embodiment of the present invention illustrating a variable impedance transformer 10. FIG. 2 and FIG. 3 are circuit representations of the first embodiment of the variable impedance transformer 10 illustrating magnetic flux directions during a first half cycle and a second half cycle of an alternating current wave. The variable impedance transformer 10 includes a first and a second saturable reactor core 11 and 21 shown as closed loop square cores with a rectangular cross section. The first saturable reactor core 11 comprises first, second, third and fourth legs 12, 13, 14, and 15 respectively. The second saturable reactor core 21 comprises first, second, third and fourth legs 22, 23, 24, and 25 respectively. A power core 31 has first, second, third and fourth legs 32, 33, 34, and 35. The power core 31 is shown as a rectangular closed loop core with a rectangular cross section.

The saturable reactor cores 11 and 21 and power core 31 are of conventional core construction being fabricated from a plurality of substantially planar lamination comprising a material with a high magnetic permeability including ferromagnetic elements or alloys thereof. For the purposes of illustration variable impedance transformer 10 is shown as an open air cooled assembly, however encapsulation of the variable impedance transformer 10 may be utilized as well as providing a water cooling means (not shown).

Since the variable impedance transformer 10 of the present invention, may be designed for operation from less than one hundred volt-amperes to several thousands of volt-amperes in capacity, the input and the output voltages, the frequency of operation, and the current capacity constitute design variable of the variable impedance transformer 10.

A DC control winding 41 having a first end 42 and a second end 43 is wound simultaneously about the second legs 13 and 23 of the first and the second saturable reactor cores 11 and 21. A first power input winding 51 having a first end 52 and a second end 53 is wound simultaneously about the first leg 32 of the power core 31 and the first leg 12 of the first saturable reactor 11. A second power input winding 61 having a first end 62 and a second end 63 is wound simultaneously about the first leg 32 of the power core 31 and the first leg 22 of the second saturable reactor 21. A power output winding 71 having a first end 72 and a second end 73 is wound about the second leg 33 of the power core 31.

The variable impedance transformer 10 as heretofore described is a conventional variable impedance transformer as should be well known to those skilled in the art. In accordance with the prior art practice, a substantial effort is made to construct the first and second saturable reactor cores 11 and 21 to be identical to one another to produce the same resultant magnetic flux from the first and the second power input windings 51 and 61. In addition, the first and second saturable reactor cores 11 and 21 are established relative to one another such that magnetic flux in the second leg 13 of the first saturable reactor core 11 opposes or cancels the magnetic flux in the second leg 23 of the second saturable reactor core 21. These prior art construction techniques sought to eliminate an AC voltage from being induced into the control winding 41. Since it is difficult to construct the first and second saturable reactor cores 11 and 21 in an identical manner, and for numerous other reasons, the prior art technique has only reduced the level of the AC voltage in the control winding 41.

To overcome this problem, the present invention incorporates an equalizing winding 81 having a first end 82 and a second end 83. The equalizing winding 81 is wound simultaneously about the second legs 13 and 23 of the first and the second saturable reactor cores 11 and 21. The first and second ends 82 and 83 of the equalizing winding 81 are either shorted or are connected to a low impedance 84. Preferably, the number of turns in the equalizing winding 81 is substantially less than the number of turns in the DC control winding 41. As will be described in greater detail hereinafter, the equalizing winding 81 solves the problems encountered by the prior art.

In accordance with the prior art practice, a wide variety of conductor dimensions may be utilized in construction of the variable impedance transformer 10 including the DC control winding 41, the equalizing winding 81, the first and second power input windings 51 and 61 and the power output winding 71. The conductor dimensions include the number of turns per winding and the winding cross-section. The winding cross-section may vary from fine insulated round, square to rectangular wire or insulated foil to metallic tubing as should be well known to those skilled in the art.

Figure 4:
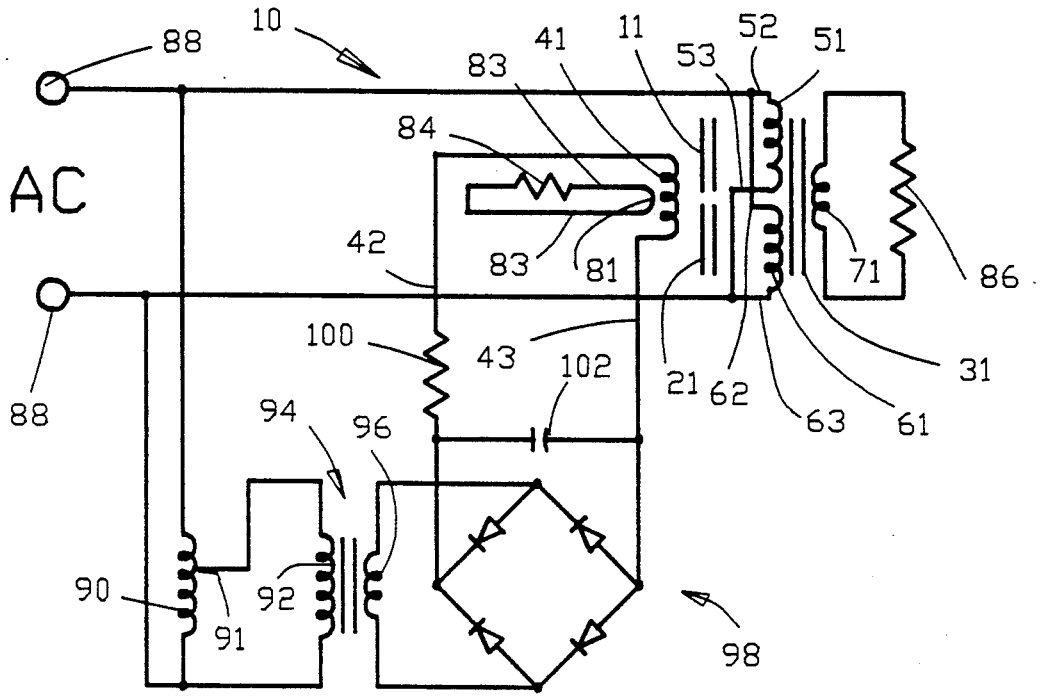
FIG. 4 is an schematic diagram of the first embodiment of the present invention shown in FIGS. 1–3 connected to an alternating current source.

FIG. 4 is an schematic diagram of the variable impedance transformer 10 of FIGS. 1–3 connected to an alternating current power supply 88. The schematic diagram of FIG. 4 is a simplified method for manually controlling the power to the load 86 from the variable impedance transformer 10. It should be appreciated by those skilled in the art that the schematic diagram of FIG. 4 is not to be interpreted as the normal method of controlling the output power of the variable impedance transformer 10. Typically, the variable impedance transformer 10 is controlled by feedback circuits, computers or the like for maintaining the power to the load 86 at a desired level.

The alternating current power supply 88 is connected to the first and second ends 52 and 53 of the first power input winding 51 and is connected to the first and second ends 62 and 63 of the second power input winding 61.

The first and second ends 72 and 73 of the power output winding 71 are connected to a load 86. The load 86 may be a furnace or lighting equipment or the like typically having a substantial operating current requirement with a significantly higher surge current required during the start of the circuit.

The alternating current power supply 88 is connected to a variable auto transformer 90 having a variable voltage tap 91 with the variable voltage tap 91 being connected to an input winding 92 of a voltage reduction transformer 94. An output winding 96 of the voltage reduction transformer 94 is connected to a DC bridge 98 for supplying a variable DC voltage to the first and second ends 42 and 43 of the control winding 41. A resistor 100 functions to limit the current through the control winding 41 whereas a capacitor 102 functions as a filter.

The variable impedance transformer 10 of the present invention operates in a manner similar to a conventional variable impedance transformer. The variable voltage tap 91 of the voltage reduction transformer 94 is positioned to supply a minimum DC voltage to the control winding 41. When the AC power supply 88 is activated, an alternating current flows through the first and the second power input windings 51 and 61 to establish a magnetic flux flow in the power core 31. In addition, alternating current flow through the first and the second power input windings 51 and 61 establishes a magnetic flux flow in the first and second saturable reactor cores 11 and 21.

Since the magnetic flux established by the current flow through the first and second input windings 51 and 61 is divided between the power core 31 and the first and second saturable reactor cores 11 and 21, the power transferred through the power core 31 and the output winding 71 to the load 86 is substantially reduced. The amount of the power reduction is dependent upon construction parameters including winding turns and core construction between the power core 31 and the first and second saturable reactor cores 11 and 21. The reduction of power transferred through the power core 31 and the output winding 71 to the load 86 compensates for the significantly higher surge current required during the start of the load 86.

As the variable voltage tap 91 of transformer 94 is positioned to supply a DC voltage to the control winding 41, an additional magnetic flux is established in the first and second saturable reactor cores 11 and 21. The additional magnetic flux established in the first and second saturable reactor cores 11 and 21 results in an increase in the level of magnetic flux flow in the power core 31 and an increase in the power transferred through the power core 31 and the output winding 71 to the load 86.

As the variable voltage tap 91 of transformer 94 is positioned to supply additional DC voltage to the control winding 41, the magnetic flux in the first and second saturable reactor cores 11 and 21 reaches magnetic flux saturation. When the magnetic flux in the first and second saturable reactor cores 11 and 21 reaches a saturation level, substantially all the magnetic flux flow established by the first and second power input windings 51 and 61 is established in the power core 31. Accordingly, substantially all of the power from the first and second power input windings 51 and 61 is transferred through the power core 31 and the output winding 71 to the load 86.

If the first and second ends 72 and 73 of the power output winding 71 of the variable impedance transformer 10 are connected to a load 86 such a furnace or lighting equipment or the like typically having a substantial operating current, the variable voltage tap 91 of the voltage reduction transformer 94 is positioned to supply a minimum DC voltage to the control winding 41. When the AC power supply 88 is activated, the high impedance provided by the first and second saturable reactor cores 11 and 21 limit the current from the output winding 71 to the load 86.

Some variable impedance transformers of the prior art have utilized the aforementioned method to cancel an induced voltage in control winding 41. However, since precisely identical winding placement combined with identical core characteristics are substantially impossible to achieve in production, non-significant differences or variations in the cores and in the windings are sufficient to produce varying levels of induced AC voltages in the DC control windings 41.

The variable impedance transformer 10 of the present invention utilizes the equalizing winding 81 wound about the second legs 13 and 23 of the first and second saturable reactor cores 11 and 21. Preferably, the number of windings in the equalizing winding 81 is substantially less than the number of windings in the DC control winding 41. The first and second ends 82 and 83 of the equalizing winding 81 may be directly connected to one another forming a completed electrical circuit or may be connected to a low impedance 84. The AC voltage induced as a result of non-significant differences or variations in the cores and in the windings is preferentially shunt dissipated by the equalizing winding 81 relative to the DC control winding 41. The AC voltage is preferentially shunt dissipated by the equalizing winding 81 relative to the DC control winding 41 since the equalizing winding 81 is selected to have a significantly lower impedance relative to the control winding 41. Since the AC circulating currents produced by induced the AC voltages are established within the equalizing winding 81, there is a substantial reduction in the AC voltage induced in the control winding 41. The value of the low impedance 84 may be adjusted to reduce the circulating currents to acceptable levels.

Figure 5:
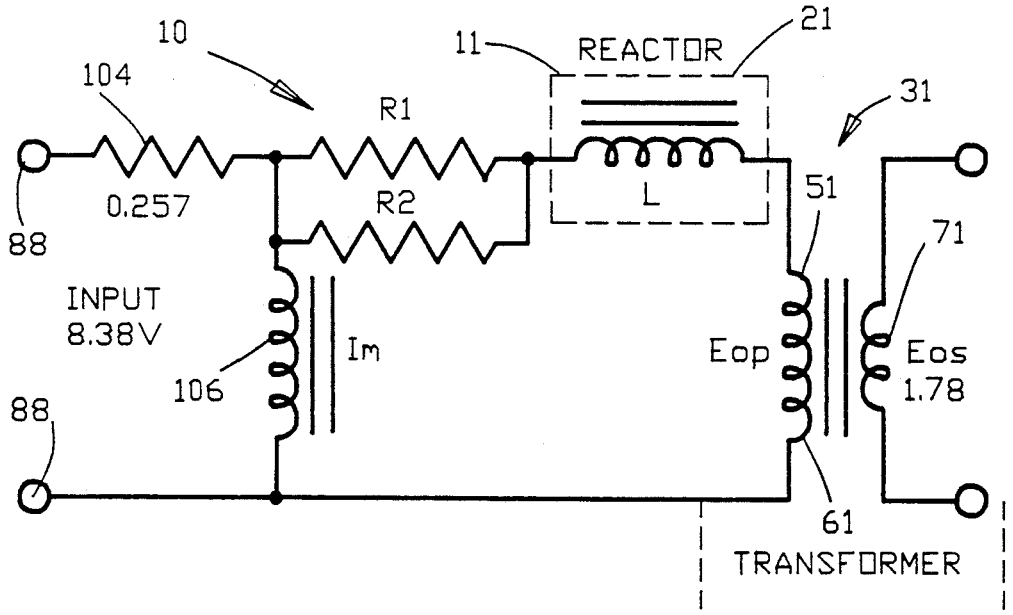
FIG. 5 is an equivalent circuit diagram of the circuit of FIG. 4.

FIG. 5 is a substantially simplified equivalent circuit of the variable impedance transformer 10. The simplified equivalent circuit variable impedance transformer 10 with the load 86 disconnected and no D.C. voltage applied to the control windings 41. The variable impedance transformer 10 is normally designed so that the impedance of the first and second saturable reactor cores 11 and 21 is equal to the impedance of the power core 31. Therefore, one-half of the input voltage 88 appears across the first and second saturable reactor cores 11 and 21 and one-half of the input voltage 88 would appears across the power core 31.

When the load 86 is connected to the output winding 71, the reflected impedance to the power core 31 is many times less than the impedance of the first and second saturable reactor cores 11 and 21. The voltage across the input windings 51 and 61 of power core 31 is substantially the ratio of the input impedance of the power core 31 to the impedance of the first and second saturable reactor cores 11 and 21 times the input voltage 88. Accordingly, with no D.C. current flowing into the control windings 41, the output power to load 86 is normally less than five percent (5%) of the capacity of the variable impedance transformer 10. As D.C. current flows into the control winding 41, the impedance of the first and second saturable reactor cores 11 and 21 drops allowing more voltage to appear across the input windings 51 and 61 of power core 31. The voltage across the input windings 51 and 61 of power core 31 progressively increases as more D.C. current flows into the control winding 41 until saturation of the first and second saturable reactor cores 11 and 21 is achieved. At saturation, the first and second saturable reactor cores 11 and 21 become essentially resistive and substantially all of the input voltage 88 appears across the input windings 51 and 61 of the power core 31.

The equivalent circuit is based on a test transformer employing three Arnold AH320 cores. The specifications of each of the cores was D=2; E=1; F=1.625 and G=4.5 and weighing 7.33 pounds. An input load resistor 104 was connected for measuring the current through the variable impedance transformer 10. Resistors R1 and R2 represent the equivalent resistance of the first and second power input windings 51 and 61 whereas the inductance 106 is the equivalent magnetizing core winding of the first and second power input windings 51 and 61. Since the magnetic flux established by the current flow through the first and second input windings 51 and 61 is divided between the power core 31 and the first and second saturable reactor cores 11 and 21 as set forth above, the first and second saturable reactor cores 11 and 21 appear in series with the first and second input windings 51 and 61 in the equivalent circuit of FIG. 5.

When a voltage of 8.38 volts was applied through the input load resistor 104 of 0.257 ohms, a voltage of 0.611 volts was measured across the input load resistor 104 ohms indicating that 2.38 amperes of current was flowing through the first and second input windings 51 and 61. The test transformer produced an open circuit voltage of 1.78 volts on the output winding 71.

Figure 6:
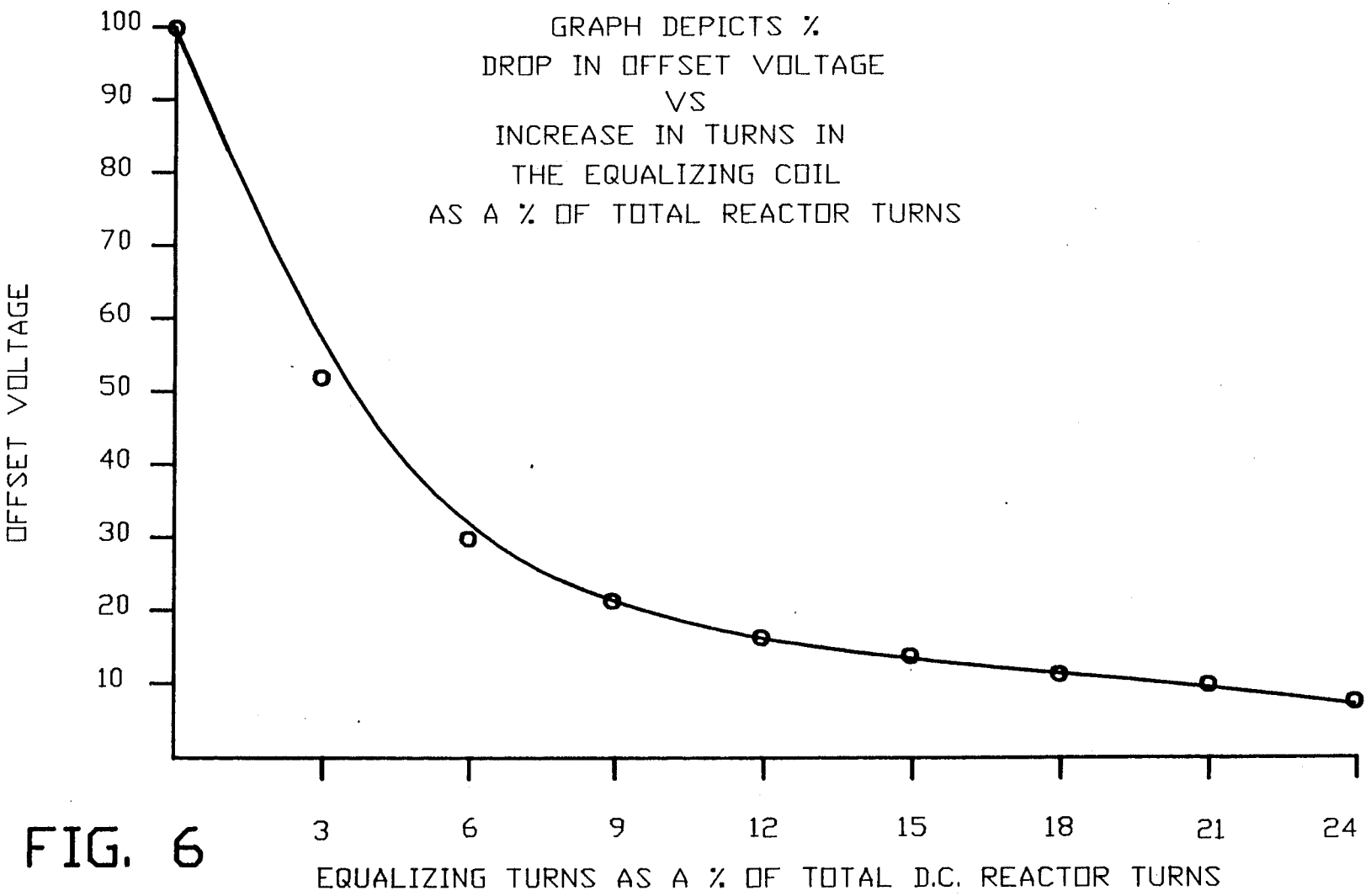
FIG. 6 is a graph of an offset voltage as a function of the number of turns of the equalizing winding.

FIG. 6 is a graph of an offset voltage (induced AC voltage) as a function of the number of turns of the equalizing winding 81. The abscissa of the graph plots the total number of turns of the equalizing winding 81 as a percentage of total number of turns of the control winding 41. The ordinate of the graph plots the percentage of offset voltage (induced AC voltage). With a zero turn equalizing winding 81, or the absence of the equalizing winding 81, the offset voltage is one hundred percent (100%) for the tested variable impedance transformer 10. With the introduction of an equalizing winding 81 having only three percent (3%) of total number of turns of the control winding 41, the offset voltage (induced AC voltage) is reduced by almost fifty percent (50%). When the number of turns of the equalizing winding 81 is increased to twelve percent (12%) of total number of turns of the control winding 41, the offset voltage (induced AC voltage) is reduced below twenty percent (20%). When the number of turns of the equalizing winding 81 is increased to twenty-four percent (24%) of total number of turns of the control winding 41, the offset voltage (induced AC voltage) is reduced below ten percent (10%). Accordingly, an equalizing winding having a small number of turns relative to the total number of turns of the control winding 41 provides a substantial reduction in the offset voltage (induced AC voltage).

The present invention may be incorporated into a variable impedance transformer of various designs and configurations as illustrated by the second and third embodiments shown in FIGS. 7–12. In addition, the equalizing winding 81 may be incorporated into a variable impedance transformer in various configurations as illustrated by the fourth embodiments shown in FIGS. 13–14.

Figure 7:
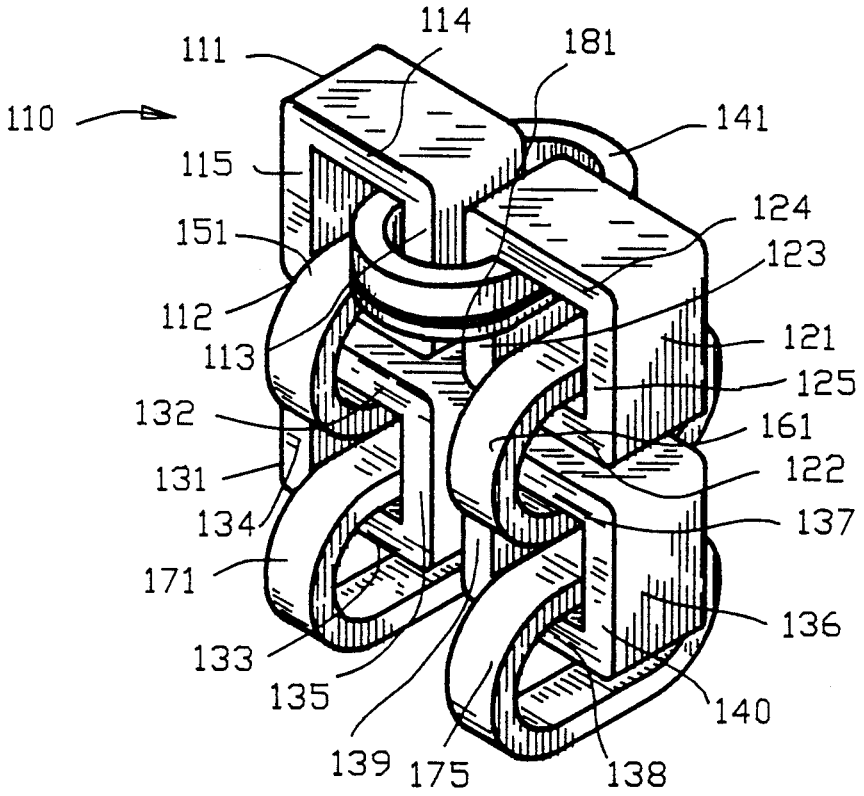
FIG. 7 is an isometric view of a second embodiment of a variable impedance transformer incorporating the present invention.
Figure 8:
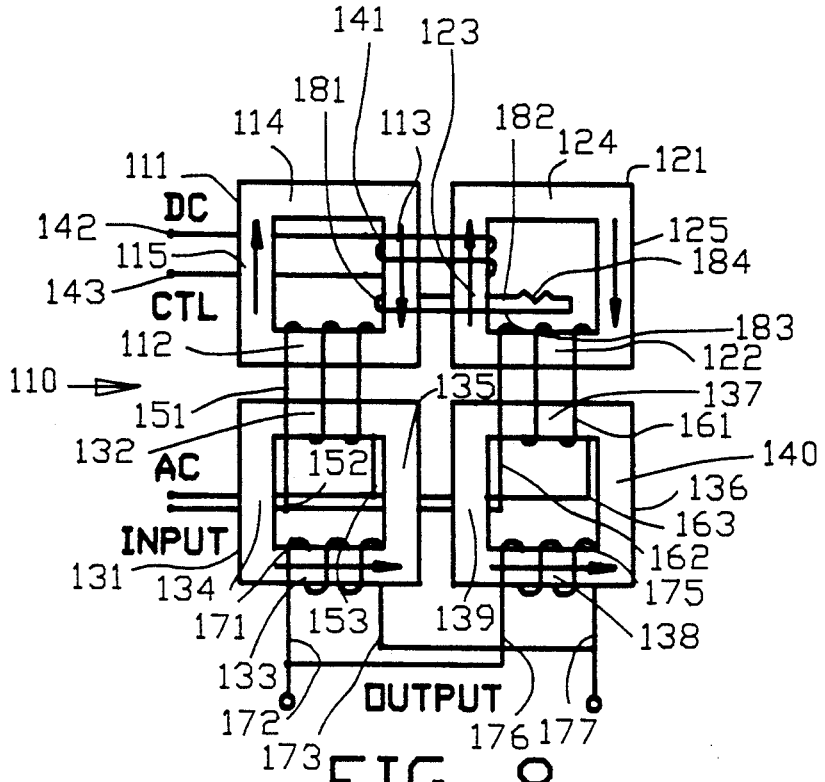
FIG. 8 is a circuit representation of the second embodiment of the variable impedance transformer illustrating the magnetic flux directions during a first half cycle of an alternating current wave.
Figure 9:
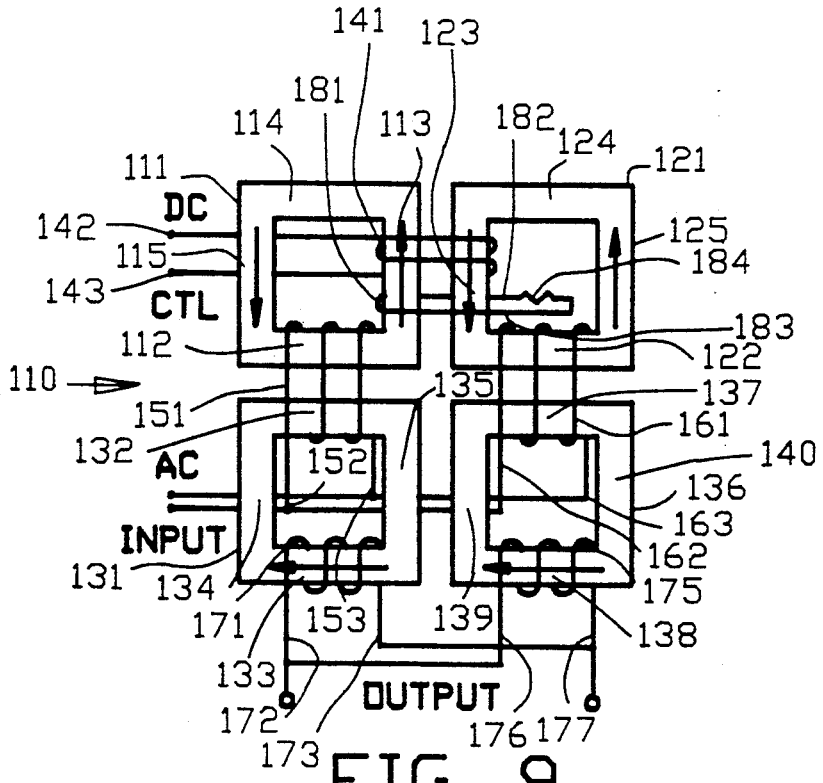
FIG. 9 is a circuit representation of the second embodiment of the variable impedance transformer illustrating the magnetic flux directions during a second half cycle of an alternating current wave.

FIG. 7 is an isometric view of a second embodiment of the present invention illustrating a variable impedance transformer 110 having a different configuration than the first embodiment shown in FIGS. 1–3. FIG. 8 and FIG. 9 are circuit representations of the second embodiment of the variable impedance transformer 110 illustrating magnetic flux directions during a first half cycle and a second half cycle of an alternating current wave. The variable impedance transformer 110 includes a first and a second saturable reactor core 111 and 121. The first saturable reactor core 111 comprises first, second, third, and fourth legs 112, 113, 114, and 115 respectively whereas the second saturable reactor core 121 comprises first, second, third and fourth legs 122, 123, 124, and 125 respectively.

In this embodiment, the power core comprises a first power core 131 having first, second, third and fourth legs 132, 133, 134, and 135 respectively, and a second power core 136 having first, second, third and fourth legs 137, 138, 139, and 140 respectively. A DC control winding 141 having a first end 142 and a second end 143 is wound simultaneously about the second legs 113 and 123 of the first and the second saturable reactor cores 111 and 121 respectively. A first power input winding 151 having a first end 152 and a second end 153 is wound simultaneously about the first leg 132 of the first power core 131 and the first leg 112 of the first saturable reactor core 111. A second power input winding 161 having a first end 162 and a second end 163 is wound simultaneously about the first leg 137 of the second power core 136 and the first leg 122 of the second saturable reactor core 121. A first power output winding 171 having a first end 172 and a second end 173 is wound about the second leg 133 of the first power core 131 whereas a second power output winding 175 having a first end 176 and a second end 177 is wound about the second leg 138 of the second power core 136. An equalizing winding 181 having a first end 182 and a second end 183 is wound simultaneously about the second legs 113 and 123 of the first and the second saturable reactor cores 111 and 121 respectively. The first and second ends 182 and 183 of the equalizing winding 181 are connected to the low impedance 184.

The variable impedance transformer 110 of the second embodiment of the invention shown in FIGS. 7–9 operates in a manner similar to the operation of the variable impedance transformer 10 of the first embodiment of the invention shown in FIGS. 1–3.

The AC voltage induced as a result of non-significant differences or variations in the cores and the windings is preferentially shunt dissipated by the equalizing winding 181 relative to the DC control winding 141 providing a substantial reduction in the AC voltage induced in the control winding 41.

Figure 10:
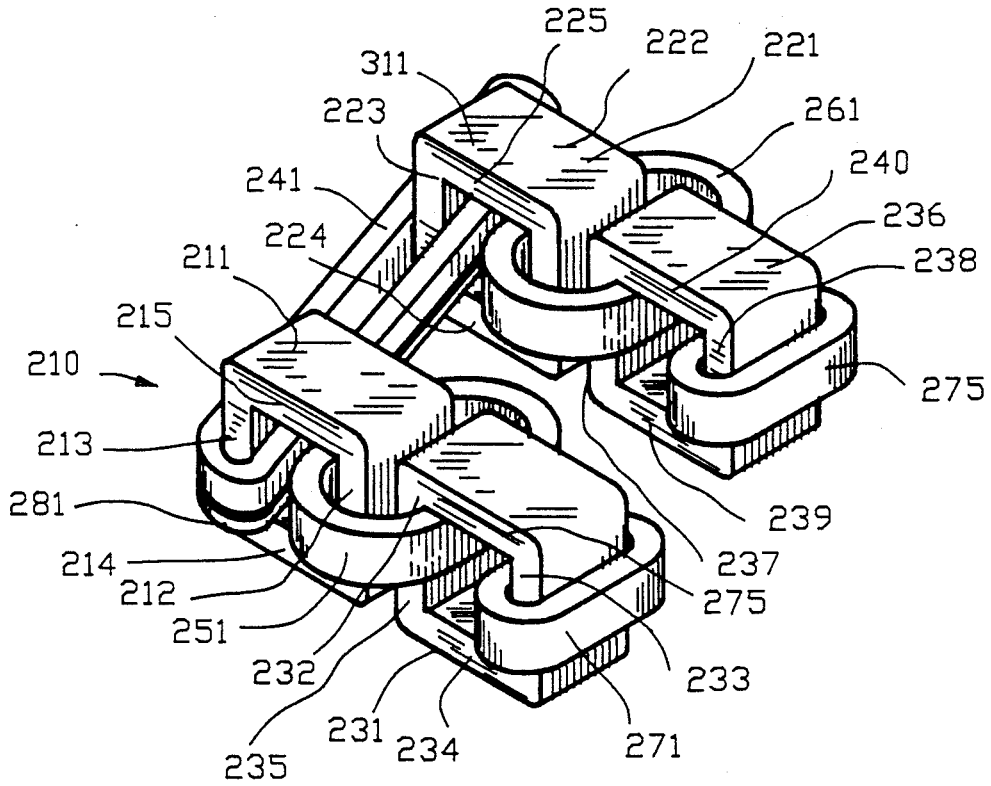
FIG. 10 is an isometric view of a third embodiment of a variable impedance transformer incorporating the present invention.
Figure 11:
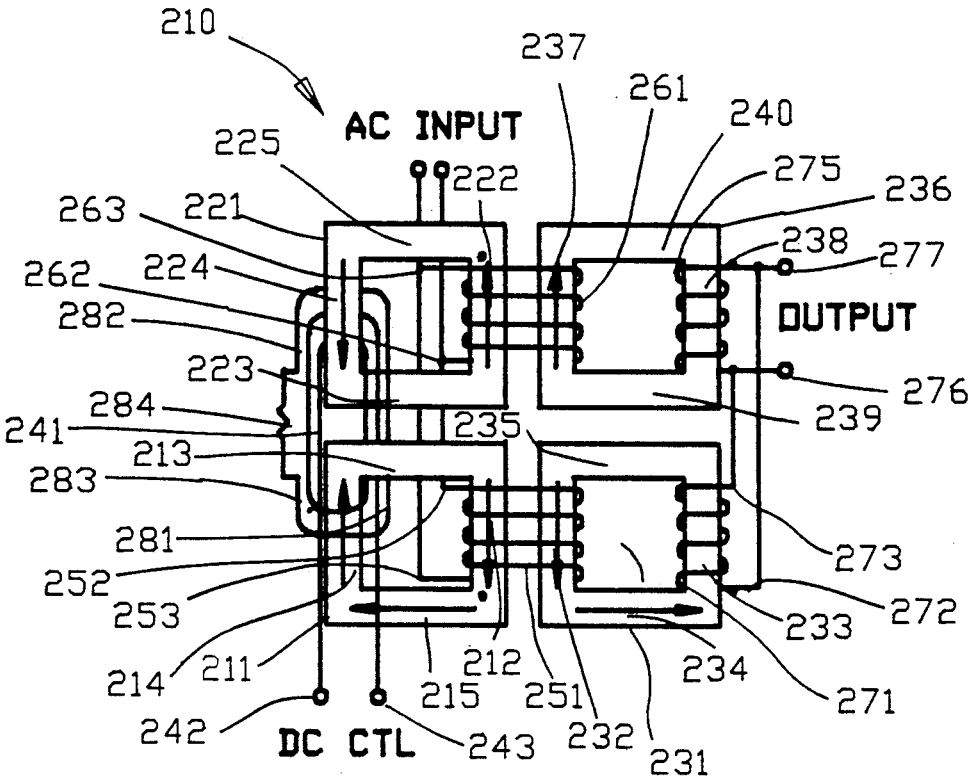
FIG. 11 is a circuit representation of the third embodiment of the variable impedance transformer illustrating the magnetic flux directions during a first half cycle of an alternating current wave.
Figure 12:
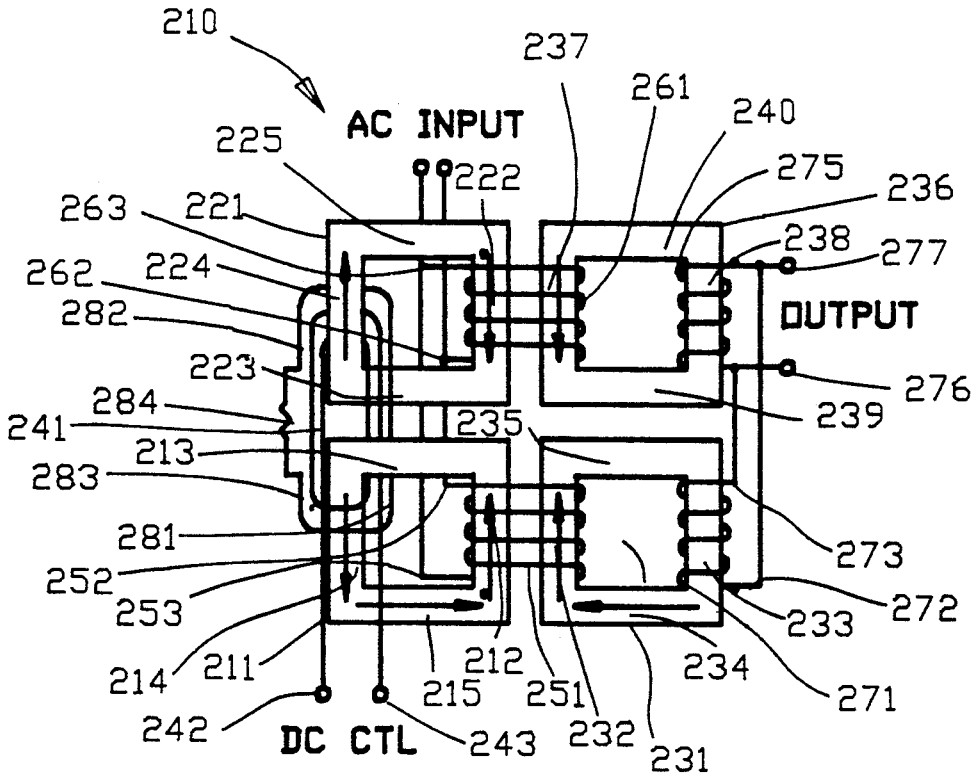
FIG. 12 is a circuit representation of the third embodiment of the variable impedance transformer illustrating the magnetic flux directions during a second half cycle of an alternating current wave.

FIG. 10 is an isometric view of a third embodiment of the present invention illustrating a variable impedance transformer 210 having still a different configuration than the first and second embodiment shown in FIGS. 1–3 and 7–9. FIG. 11 and FIG. 12 are circuit representations of the third embodiment of the variable impedance transformer 210 illustrating magnetic flux directions during a first half cycle and a second half cycle of an alternating current wave. The variable impedance transformer 210 includes a first and a second saturable reactor core 211 and 221. The first saturable reactor core 211 comprises first, second, third, and fourth legs 212, 213, 214, and 215 respectively, whereas the second saturable reactor core 221 comprises first, second, third, and fourth legs 222, 223, 224, and 225 respectively.

A first power core 231 includes a first, second, third and fourth legs 232, 233, 234, and 235 respectively, whereas a second power core 236 includes a first, second, third and fourth legs 237, 238, 239, and 240 respectively. A DC control winding 241 having a first end 242 and a second end 243 is wound simultaneously about the second legs 213 and 223 of the first and the second saturable reactor cores 211 and 221 respectively. A first power input winding 251 having a first end 252 and a second end 253 is wound simultaneously about the first leg 232 of the first power core 231 and the first leg 212 of the first saturable reactor core 211. A second power input winding 261 having a first end 262 and a second end 263 is wound simultaneously about the first leg 237 of the second power core 236 and the first leg 222 of the second saturable reactor core 221. A first power output winding 271 having a first end 272 and a second end 273 is wound about the second leg 233 of the first power core 231 whereas a second power output winding 275 having a first end 276 and a second end 277 is wound about the second leg 238 of the second power core 236.

An equalizing winding 281 having a first end 282 and a second end 283 is wound simultaneously about the second legs 213 and 223 of the first and the second saturable reactors cores 211 and 221 respectively, with the first and second ends 282 and 283 being connected to the low impedance 284.

The variable impedance transformer 210 of the third embodiment of the invention shown in FIGS. 10–12 operates in a manner similar to the operation of the variable impedance transformers 10 and 110 of the first and second embodiments shown in FIGS. 1–3 and 7–9. The AC voltage induced by non-significant variations in the cores and the windings is preferentially shunt dissipated by the equalizing winding 281 providing a substantial reduction in the AC voltage induced in the control winding 241.

The variable impedance transformer 210 of FIGS. 10–12 operates in a manner similar to the variable impedance transformer 110 of FIGS. 7–9. In contrast to the variable impedance transformer 110 of FIGS. 7–9, the magnetic flux in the first power core 231 and the first saturable reactor core 211 flows in an opposite direction relative to the magnetic flux in the second power core 236 and the second saturable reactor core 221 in the variable impedance transformer 210 of FIGS. 10–12. The opposite magnetic flux in the first and second power cores 231 and 236 and in the first and second saturable reactor cores 211 and 236 is the result of the first power input winding 251 being wound in a direction opposite to the second power input winding 261.

The first embodiment of the variable impedance transformer 10 shown in FIGS. 1–3 has several advantages over the second embodiment of the variable impedance transformer 110 shown in FIGS. 7–9 and the third embodiment of the variable impedance transformer 210 shown in FIGS. 10–12. The first embodiment of the variable impedance transformer 10 shown in FIGS. 1–3 only requires a single power core 31 and first and second saturable reactor cores 11 and 21 in contrast to the plural power core 131 and 140 of FIGS. 7–9 and the plural power core 231 and 240 of FIGS 10–12. Accordingly, the first embodiment of the variable impedance transformer 10 of FIGS. 1–3 has a reduced weight of approximately sixty-seven percent (67%) over the second and third embodiments of the variable impedance transformer 110 and 210.

The second and third embodiments of the variable impedance transformer 110 and 210 of FIGS. 7–9 and FIGS. 10–12 have an advantage over the first embodiment of the variable impedance transformer 10 shown in FIGS. 1–3 since the output windings 171 and 175 of FIGS. 7–9 and the output windings 271 and 275 of FIGS. 10–12 can easily be wound inside the input windings 151 and 161 of FIGS. 7–9 and the input windings 251 and 261 of FIGS. 10–12 to provide a superior coupling between the input windings and the output windings.

Figure 13:
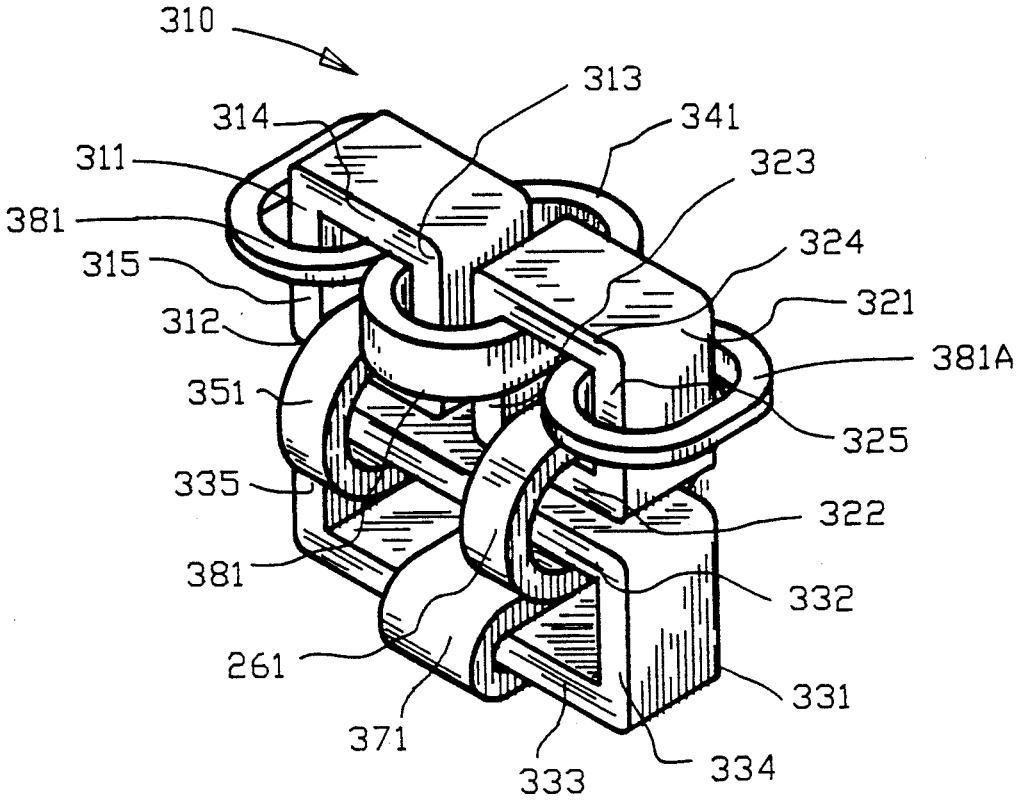
FIG. 13 is an isometric view of a fourth embodiment of a variable impedance transformer incorporating the present invention.
Figure 14:
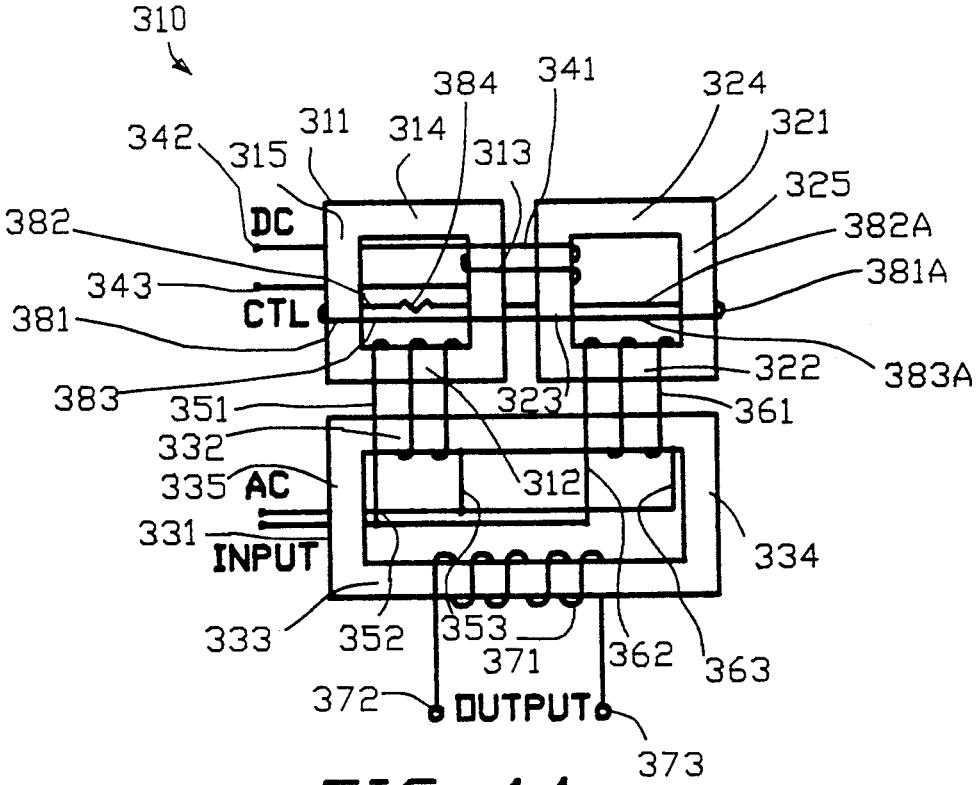
FIG. 14 is a circuit representation of the fourth embodiment of the variable impedance transformer.

FIG. 13 is an isometric view of a fourth embodiment of the present invention illustrating a variable impedance transformer 310 with FIG. 14 being a circuit representations thereof. The variable impedance transformer 310 is similar to the first embodiment shown in FIGS. 1–3 and includes a first and a second saturable reactor core 311 and 321. The first saturable reactor core 311 comprises a first, second, third and fourth legs 312, 313, 314, and 315 respectively. The second saturable reactor core 321 comprises a first, second, third and fourth legs 322, 323, 324, and 325 respectively. A power core 331 has first, second, third and fourth legs 332, 333, 334, and 335.

A DC control winding 341 having first and second ends 342 and 343 is wound simultaneously about the second legs 313 and 323 of the first and the second saturable reactor cores 311 and 321. A first power input winding 351 having first and second ends 352 and 353 is wound simultaneously about the first leg 332 of the power core 331 and the first leg 312 of the first saturable reactor core 311. A second power input winding 361 having first and second ends 362 and 363 is wound simultaneously about the first leg 332 of the power core 331 and the first leg 322 of the second saturable reactor core 321. A power output winding 371 having first and second ends 372 and 373 is wound about the second leg 333 of the power core 331.

In this embodiment, the variable impedance transformer 310 comprises a first and a second equalizing winding 381 and 381A. The first and second equalizing windings 381 and 381A are independently wound about the fourth legs 315 and 325 of the first and the second saturable reactor cores 311 and 321. The first equalizing winding 381 includes first and second ends 382 and 383 whereas the second equalizing winding 381A includes first and second ends 382A and 383A. The first equalizing winding 381 is wound in opposition to the second equalizing winding 381A with a low impedance 384 interconnection the first ends 382 and 382A of the first and second equalizing windings 381 and 381A. The second ends 383 and 383A of the first and second equalizing windings 381 and 381A are directly interconnected.

In a manner similar to the equalizing winding 81 of FIGS. 1–3, the first and second equalizing windings 381 and 381A preferentially shunt dissipate from the DC control winding 341, the AC voltage induced as a result of non-significant differences or variations in the cores and the windings. More specifically, any difference of voltage induced within the first and second equalizing windings 381 and 381A will cancel with one another to produce a resultant voltage within one of the first and second equalizing windings 381 and 381A. The resultant voltage within the one of the first and second equalizing windings 381 and 381A will induce a magnetic flux in opposition to the original AC flux developed as a result of non-significant differences or variations in the cores and the windings. Preferably, the first and second equalizing windings 381 and 381A are selected to have a significantly lower impedance relative to the control winding 341.

It should be appreciated by those skilled in the art that a single or multiple equalizing windings may be utilized in any of the embodiments set forth herein. In addition, the use of equalizing winding may be applied to variable impedance transformers of various designs and constructions as well as auto transformers and the like. It should also be appreciated by those skilled in the art that the principals set forth herein are equally applicable to either single phase or three phase operation.

Although the saturable reactor cores and are illustrated as employing substantially square closed loop cores with rectangular cross-sections and the power core is illustrated as employing a rectangular closed loop core with a rectangular cross-section, it should be understood that other core configurations may be utilized within the scope of the present invention. In addition to square and rectangular cores, oval cores, torroidal cores, "C" cores, and distributed air gap cores may be used with equal success. The utilization of "C" cores provides a simple core winding process prior to the joining of two "C" core assemblies. Distributed air gap cores provide the same ease of winding, but provide a more uniform magnetic flux flow around the closed loop core, since the air gap spaces are distributed about the closed loop. Core cross-sections may likewise include square, rectangular and crucifix cross-sections as is well known to those skilled in the art.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A variable impedance transformer for controlling the power from an alternating input power source to a load in accordance with a direct current control signal, comprising:

a first and second saturable reactor core;

power core means;

a first and a second power input winding being simultaneously wound about said power core means and said first and second saturable reactor cores, respectively;

means connecting said first and second power input windings in parallel across the alternating input power source for establishing a magnetic flux in said power core means and for establishing a magnetic flux in said first and second saturable reactor cores;

a power output means winding for transferring power to the load;

a control winding being simultaneously wound about said first and second saturable reactor cores for controlling saturation of magnetic flux in said first and second saturable reactor cores in accordance with the direct current control signal;

first and second saturable reactor cores and said first and second power input windings being established to substantially cancel said magnetic flux proximate said control winding leaving only a non-substantial magnetic flux proximate said control winding as a result of non-substantial physical variations between said first and second saturable reactor cores;

a low impedance equalizing winding having a plurality of turns being wound about said first and second saturable reactor cores; and said low impedance equalizing winding having a number of equalizing winding turns that is greater than approximately six percent of the number of turns of said control winding for producing a magnetic flux proximate said control winding in a direction opposite to said non-substantial magnetic flux for reducing the voltage induced within the control winding by said non-substantial magnetic flux.

2. A variable impedance transformer as set forth in claim 1, wherein said power output winding means is wound about said power core means.

3. A variable impedance transformer as set forth in claim 1, wherein said equalizing winding is connected to a low impedance for shunting any resultant alternating voltage induced by said first and second saturable reactor cores.

4. A variable impedance transformer as set forth in claim 1, wherein said equalizing winding is shorted for shunting any resultant alternating voltage induced by said first and second saturable reactor cores.

5. A variable impedance transformer as set forth in claim 1, wherein each of said first and second saturable reactor cores and said power core means provide a closed loop for said magnetic flux.

6. A variable impedance transformer as set forth in claim 1, wherein said first and second saturable reactor cores and said first and second power input windings are substantially identical to one another for substantially canceling said magnetic flux proximate said control winding.

7. A variable impedance transformer as set forth in claim 1, wherein said power core means comprises a first power core;

said first power input winding being simultaneously wound about said first power core and said first saturable reactor core;

said second power input winding being simultaneously wound about said first power core and said second saturable reactor core; and said power output winding means comprising a first power output winding wound about said first power core.

8. A variable impedance transformed as set forth in claim 1, wherein said equalizing winding is simultaneously wound about said first and second saturable reactor cores.

9. A variable impedance transformer as set forth in claim 1, wherein said equalizing winding comprises a first and a second equalizing winding; and said first and second equalizing windings being wound about said first and second saturable reactor cores, respectively.

10. A variable impedance transformer for controlling the power from an alternating input power source to a load in accordance with a direct current control signal, comprising:

a first and a second saturable reactor core;

power core means;

a first and a second power input winding being simultaneously wound about said power core means and said first and second saturable reactor cores, respectively;

means connecting said first and second power input windings in parallel across the alternating input power source for establishing a magnetic flux in said power core means and for establishing a magnetic flux in said first and second saturable reactor cores;

a power output means winding for transferring power to the load;

a control winding being simultaneously wound about said first and second saturable reactor cores for controlling saturation of magnetic flux in said first and second saturable reactor cores in accordance with the direct current control signal;

said first and second saturable reactor cores and said first and second power input windings being established to substantially cancel said magnetic flux proximate said control winding;

a low impedance equalizing winding being wound about said first and second saturable reactor cores for shunting any resultant alternating voltage induced by any residual magnetic flux as a result of non-substantial physical variations between said first and second saturable reactor cores;

said power core means comprising a first and second power core;

said first power input winding being simultaneously wound about said first power core and said first saturable reactor core;

said second power input winding being simultaneously wound about said second power core and said second saturable reactor core;

said means connecting said first and second power input windings across the alternating input power source establishing a magnetic flux in said first and said second power cores propagating in the same direction;

said power output winding means comprising a first power output winding wound about said first power core and a second power output winding about said second power core; and means connecting said first and second power output windings in parallel.

11. A variable impedance transformer for controlling the power from an alternating input power source to a load in accordance with a direct current control signal, comprising:

a first and a second saturable reactor core;

power core means;

a first and a second power input winding being simultaneously wound about said power core means and said first and second saturable reactor cores, respectively;

means connecting said first and second power input windings in parallel across the alternating input power source for establishing a magnetic flux in said power core means and for establishing a magnetic flux in said first and second saturable reactor cores;

a power output means winding for transferring power to the load;

a control winding being simultaneously wound about said first and second saturable reactor cores for controlling saturation of magnetic flux in said first and second saturable reactor cores in accordance with the direct current control signal;

said first and second saturable reactor cores and said first and second power input windings being established to substantially cancel said magnetic flux proximate said control winding;

a low impedance equalizing winding being wound about said first and second saturable reactor cores for shunting any resultant alternating voltage induced by any residual magnetic flux as a result of non-substantial physical variations between said first and second saturable reactor cores;

said power core means comprising a first and second power core;

said first power input winding being simultaneously wound about said first power core and said first saturable reactor core;

said second power input winding being simultaneously wound about said second power core and said second saturable reactor core;

said means connecting said first and second power input windings across the alternating input power source establishing a magnetic flux in said first and said second power cores propagating in the opposing directions;

said power output winding means comprising a first power output winding wound about said first power core and a second power output winding wound about said second power core; and means connecting said first and second power output windings in parallel.

12. A variable impedance transformer for controlling the power from an alternating input power source to a load, in accordance with a direct current control signal, comprising:

a first and a second saturable reactor core each having a first leg and a second leg;

said first and second saturable reactor core being substantially identical to one another;

power core means having a primary leg and a secondary leg;

a first and a second power input winding each having a first end and a second end;

said first and a second power input windings being substantially identical to one another;

a power output winding means having a first end and a second end;

a control winding having a first end and a second end;

said first power input winding being simultaneously wound about said primary leg of said power core means and said first and leg of said first saturable reactor core, said second power input winding being simultaneously wound about said primary leg of said power core means and said first and leg of said first saturable reactor core, said power output winding means being wound around said secondary leg of said power core means transferring power to the load;

said control winding being simultaneously wound about said second leg of said first saturable reactor core and said second leg of said second saturable reactor core, means connecting said first end of said first power input winding with said first end of said second power input winding and connecting said second end of said first power input winding with said second end of said second power input winding;

means connecting said first and second power input windings to the alternating input power source for establishing a magnetic flux in said power core means and said first and second saturable reactor cores;

means for positioning said first and second saturable reactor cores for enabling said magnetic flux in said second leg of said first saturable reactor core to substantially cancel said magnetic flux in said second leg of said second saturable reactor core leaving only a non-substantial magnetic flux proximate said control winding as a result of non-substantial physical variations between said first and second saturable reactor cores;

means connecting said first and second ends of said control winding to the direct current control signal for controlling said magnetic flux in said first and second saturable reactor cores to control the saturation thereof; and an equalizing winding having a plurality of turns being wound about said second leg of said first saturable reactor core and said second leg of said second saturable reactor core; and said equalizing winding having a number of equalizing winding turns that is greater than approximately six percent of the number of turns of said control winding for producing a magnetic flux proximate said control winding in a direction opposite to said non-substantial magnetic flux for reducing the voltage induced within the control winding by said non-substantial magnetic flux.

13. A variable impedance transformer as set forth in claim 12, wherein said power output winding means is wound about said power core means.

14. A variable impedance transformer as set forth in claim 12, wherein said equalizing winding is connected to a low impedance for shunting any resultant alternating voltage induced by said first and second saturable reactor cores.

15. A variable impedance transformer as set forth in claim 12, wherein said equalizing winding is shorted for shunting any resultant alternating voltage induced by said first and second saturable reactor cores.

16. A variable impedance transformer as set forth in claim 12, wherein each of said first and second saturable reactor cores and said power core means provide a closed loop for said magnetic flux.

17. A variable impedance transformer as set forth in claim 12, said power core means comprises a first power core;

said first power input winding being simultaneously wound about said first power core and said first saturable reactor cores;

said second power input winding being simultaneously wound about said first power core and said saturable reactor core; and said power output winding means comprising a first power output winding wound about said first power core.

18. A variable impedance transformer as set forth in claim 12, wherein said equalizing winding is simultaneously wound about said first and second saturable reactor cores.

19. A variable impedance transformer as set forth in claim 12, wherein said equalizing winding comprises a first and a second equalizing winding; and said first and second equalizing windings being wound about said first and second saturable reactor cores, respectively.

20. A variable impedance transformer for controlling the power from an alternating input power source to a load, in accordance with a direct current control signal, comprising:

a first and a second saturable reactor core each having a first leg and a second leg;

said first and second saturable reactor core being substantially identical to one another;

a power core means having a primary leg and a secondary leg;

a first and a second power input winding each having a first end and a second end;

said first and a second power input windings being substantially identical to one another;

a power output winding means having a first end and a second end;

a control winding having a first end and a second end;

said first power input winding being simultaneously wound about said primary leg of said power core means and said first leg of said first saturable reactor core;

said second power input winding being simultaneously wound about said primary leg of said power core means and said first leg of said second saturable reactor core;

said power output winding being wound around said secondary leg of said power core means transferring power to the load;

said control winding being simultaneously wound about said second leg of said first saturable reactor core and said second leg of said second saturable reactor core;

means connecting said first end of said first power input winding with said first end of said second power input winding and connecting said second end of said first power input winding with said second end of said second power input winding;

means connecting said first and second power input windings to the alternating input power source for establishing a magnetic flux in said power core means and said first and second saturable reactor cores;

means for positioning said first and second saturable reactor cores for enabling said magnetic flux in said second leg of said first saturable reactor core to substantially cancel said magnetic flux in said second leg of said second saturable reactor core;

means connecting said first and second ends of said control winding to the direct current control signal for controlling said magnetic flux in said first and second saturable reactor cores to control the saturation thereof;

an equalizing winding being wound about said second leg of said first saturable reactor core and said second leg of said second saturable reactor core for shunting any resultant alternating voltage induced by any residual magnetic flux between said second legs of said first and second saturable reactor cores due to non-substantial physical variations therebetween;

said power core means comprising a first and second power core;

said first power input winding being simultaneously wound about said first power core and said first saturable reactor cores; and said second power input winding being simultaneously wound about said second power core and said second saturable reactor core.

21. A variable impedance transformer for controlling the power from an alternating input power source to a load, in accordance with a direct current control signal, comprising:

a first and a second saturable reactor core each having a first leg and a second leg;

said first and second saturable reactor core being substantially identical to one another;

a power core means having a primary leg and a secondary leg;

a first and a second power input winding each having a first end and a second end;

said first and a second power input windings being substantially identical to one another;

a power output winding means having a first end and a second end;

a control winding having a first end and a second end;

said first power input winding being simultaneously wound about said primary leg of said power core means and said first leg of said first saturable reactor core;

said second power input winding being simultaneously wound about said primary leg of said power core means and said first leg of said second saturable reactor core;

said power output winding being wound around said secondary leg of said power core means transferring power to the load;

said control winding being simultaneously wound about said second leg of said first saturable reactor core and said second leg of said second saturable reactor core;

means connecting said first end of said first power input winding with said first end of said second power input winding and connecting said second end of said first power input winding with said second end of said second power input winding;

means connecting said first and second power input windings to the alternating input power source for establishing a magnetic flux in said power core means and said first and second saturable reactor cores;

means for positioning said first and second saturable reactor cores for enabling said magnetic flux in said second leg of said first saturable reactor core to substantially cancel said magnetic flux in said second leg of said second saturable reactor core;

means connecting said first and second ends of said control winding to the direct current control signal for controlling said magnetic flux in said first and second saturable reactor cores to control the saturation thereof;

an equalizing winding being wound about said second leg of said first saturable reactor core and said second leg of said second saturable reactor core for shunting any resultant alternating voltage induced by any residual magnetic flux between said second legs of said first and second saturable reactor cores due to non-substantial physical variations therebetween;

said power core means comprising a first and second power core;

said first power input winding being simultaneously wound about said first power core and said first saturable reactor cores; and said second power input winding being simultaneously wound about said second power core and said second saturable reactor core; and said means connecting said first and second power input windings in parallel across the alternating input power source for establishing a magnetic flux in said power core means connects said first and said second power input windings in parallel opposition.

22. The method of reducing a residual alternating voltage across a control winding of a variable impedance transformer having a first and a second saturable reactor core and a power core means;

winding identical first and second power input windings about the power core means and the first and second saturable reactor cores, respectively;

winding a control winding about the first and second saturable reactor cores;

winding a plurality of turns of an equalizing winding about the first and second saturable reactor cores having a number of equalizing winding turns that is greater than approximately six percent of the number of turns of the control winding for producing a magnetic flux proximate the control winding in a direction opposite to the non-substantial magnetic flux for reducing the voltage induced within the control winding by the non-substantial magnetic flux; and connecting the equalizing winding to a low impedance for producing a magnetic flux proximate the control winding in a direction opposite to the non-substantial magnetic flux for reducing the voltage induced within the control winding by the non-substantial magnetic flux.

* * * * *

UNITED STATES PATENT AND TRADEMARK OFFICE

CERTIFICATE OF CORRECTION

PATENT NO. : 5,163,173

DATED : November 10, 1992

INVENTOR(S) : Serge Casagrande

It is certified that error appears in the above-identified patent and that said Letters Patent is hereby corrected as shown below:

Claim 1, column 15, lines 54 and 55, delete "having a plurality of turns".
Claim 8, column 16, line 32, delete "transformed" and insert therefor --transformer--.
Claim 12, column 18, line 29, delete "and" (second occurence).
Claim 12, column 18, line 33, delete "and" (second occurence).

Signed and Sealed this

Twenty-fifth Day of January, 1994

*Attest:*

*Attesting Officer*

BRUCE LEHMAN

*Commissioner of Patents and Trademarks*